US009592419B1

(12) United States Patent
Cuffe

(10) Patent No.: US 9,592,419 B1
(45) Date of Patent: Mar. 14, 2017

(54) PLANKING DEVICE

(71) Applicant: Tenroy Cuffe, Howell, NJ (US)

(72) Inventor: Tenroy Cuffe, Howell, NJ (US)

( * ) Notice: Subject to any disclaimer, the term of this patent is extended or adjusted under 35 U.S.C. 154(b) by 225 days.

(21) Appl. No.: 14/504,510

(22) Filed: Oct. 2, 2014

Related U.S. Application Data

(60) Provisional application No. 61/920,585, filed on Dec. 24, 2013.

(51) Int. Cl.
*A63B 23/02* (2006.01)
*A63B 23/12* (2006.01)

(52) U.S. Cl.
CPC ..... *A63B 21/4035* (2015.10); *A63B 23/1236* (2013.01)

(58) Field of Classification Search
CPC ..... A63B 22/20; A63B 22/201; A63B 22/203; A63B 22/205; A63B 22/206; A63B 22/208; A63B 21/4033; A63B 21/4035; A63B 23/1236; A63B 2208/0257; A63B 2208/0261; A63B 2208/0242
See application file for complete search history.

(56) References Cited

U.S. PATENT DOCUMENTS

| | | | | |
|---|---|---|---|---|
| 4,358,106 | A | 11/1982 | Shadford | |
| 5,181,897 | A | 1/1993 | Agan | |
| 5,226,868 | A | 7/1993 | Montgomery | |
| 6,471,623 | B1 | 10/2002 | Lin | |
| 7,156,791 | B2 | 1/2007 | Edwards | |
| 7,645,218 | B2 * | 1/2010 | Potok | A63B 23/1245 482/139 |
| 7,713,182 | B2 | 5/2010 | Bizzell et al. | |
| 7,951,055 | B2 | 5/2011 | Mulderrig et al. | |
| 8,033,968 | B2 | 10/2011 | Chen et al. | |
| 8,343,021 | B1 | 1/2013 | Seraydarian et al. | |
| 2004/0077468 | A1 * | 4/2004 | Myles, Sr. | A63B 23/0222 482/140 |
| 2011/0190096 | A1 * | 8/2011 | Clarke | A61H 1/0237 482/4 |

FOREIGN PATENT DOCUMENTS

| | | |
|---|---|---|
| WO | WO8402660 | 7/1984 |
| WO | WO9417864 | 8/1994 |
| WO | WO2009146353 | 12/2009 |

* cited by examiner

*Primary Examiner* — Loan H Thanh
*Assistant Examiner* — Rae Fischer
(74) *Attorney, Agent, or Firm* — Goldstein Law Offices, P.C.

(57) ABSTRACT

A planking device for assisting in the performance of a plank exercise. The device comprises a pair of padded arm rests coupled to a front crossbar. The front crossbar has an electronic timer operative for measuring the plank exercise duration, the timer coupled to the front crossbar. A pair of grips extend upwardly near the front of each arm rest, the grips have a starter button for selectively activating and deactivating the timer, the timer selectively activated when a plank exercise is initiated, the timer selectively deactivated when the plank exercise is completed, the timer measuring the duration of the plank exercise.

12 Claims, 7 Drawing Sheets

PLANKING DEVICE

CROSS REFERENCES AND RELATED SUBJECT MATTER

This application relates to subject matter contained in provisional patent application Ser. No. 61/920,585, filed in the United States Patent Office on Dec. 24, 2013.

TECHNICAL FIELD

The present disclosure relates generally to an exercise aid. More particularly, the present disclosure relates to a planking device for aiding the performance of the plank.

BACKGROUND

A current trend in physical training for both athletes and non-athletes is strengthening the core. The core generally refers to the torso of the body. The major muscles of the core reside in the area of the stomach and the mid and lower back. Functional movements that involve multi-planar, multi-joint movements place a demand on the body's core and lack of core development can result in a predisposition to injury when exercising or competing.

Core strengthening generally involves abdominal and back muscle systems and have traditionally included sit-ups, curls and push-ups. Popular practices such as Pilates and yoga have introduced a new exercise, commonly called the plank. The plank is an isometric exercise that involves maintaining a difficult position for extended periods of time. Performing this exercise is often called planking. The most common plank is the front plank, in which the body is held in a push-up position with the body's weight borne on forearms, elbows, and toes. A side plank, also popular, is performed by assuming a lateral position and maintaining the body's weight on a forearm of one arm.

Unlike sit-ups and curls, where the number of repetitions are important, the important measure of planking is duration. Generally, planking novices strive for holding the position for a minimum of thirty-seconds, gradually increasing endurance to a minute or more. Accurately timing the plank is a challenge without a trainer or partner to assist.

The challenge of timing the duration when performing solo is increased by the constraints of maintaining a proper pose for the plank. The head, neck and spine must be in a "neutral" position or straight line. Lifting the head up to look at a wall clock breaks the proper pose. Engaging a watch or electronic timer on the floor requires a free hand, but the hands are engaging the mat or floor during the proper pose.

While certain aspects of conventional technologies are herein discussed to facilitate the present disclosure, no technical aspects are disclaimed and it is contemplated that the claims may encompass one or more of the conventional technical aspects discussed herein.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

BRIEF SUMMARY

An aspect of an example embodiment in the present disclosure is to provide a comfortable device for performing a plank exercise, protecting the forearms from friction and pressure. Accordingly, the present disclosure provides a planking device having padded arm rests for resting the forearms during the plank exercise, protecting the forearms from rough carpeting and hard flooring.

Another aspect of an example embodiment in the present disclosure is to provide a timer that helps a user maintain neck, head and spine in a neutral pose during a plank exercise while monitoring the duration of the plank exercise. Accordingly, the present disclosure provides a planking device having a timer on a crossbar between two arm rests, the timer in a user's line of vision when maintaining the neutral pose, the user monitoring the duration with the timer.

A further aspect of an example embodiment in the present disclosure is to provide a timer that is activated while the user maintains a neutral pose during a plank exercise. Accordingly, the present disclosure provides a planking device having a pair of grips on arm rests, a grip having a starter button for selectively activating the timer, the user maintaining a neutral pose by grasping the grip and activating the starter button with a thumb without moving the head, neck and spine in the neutral position.

Accordingly, the present disclosure describes a planking device for assisting in the performance of a plank exercise. The device comprises a pair of padded arm rests coupled to a front crossbar. The front crossbar has an electronic timer operative for measuring the plank exercise duration, the timer coupled to the front crossbar. A pair of grips extend upwardly near the front of each arm rest, the grips have a starter button for selectively activating and deactivating the timer, the timer selectively activated when a plank exercise is initiated, the timer selectively deactivated when the plank exercise is completed, the timer measuring the duration of the plank exercise.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
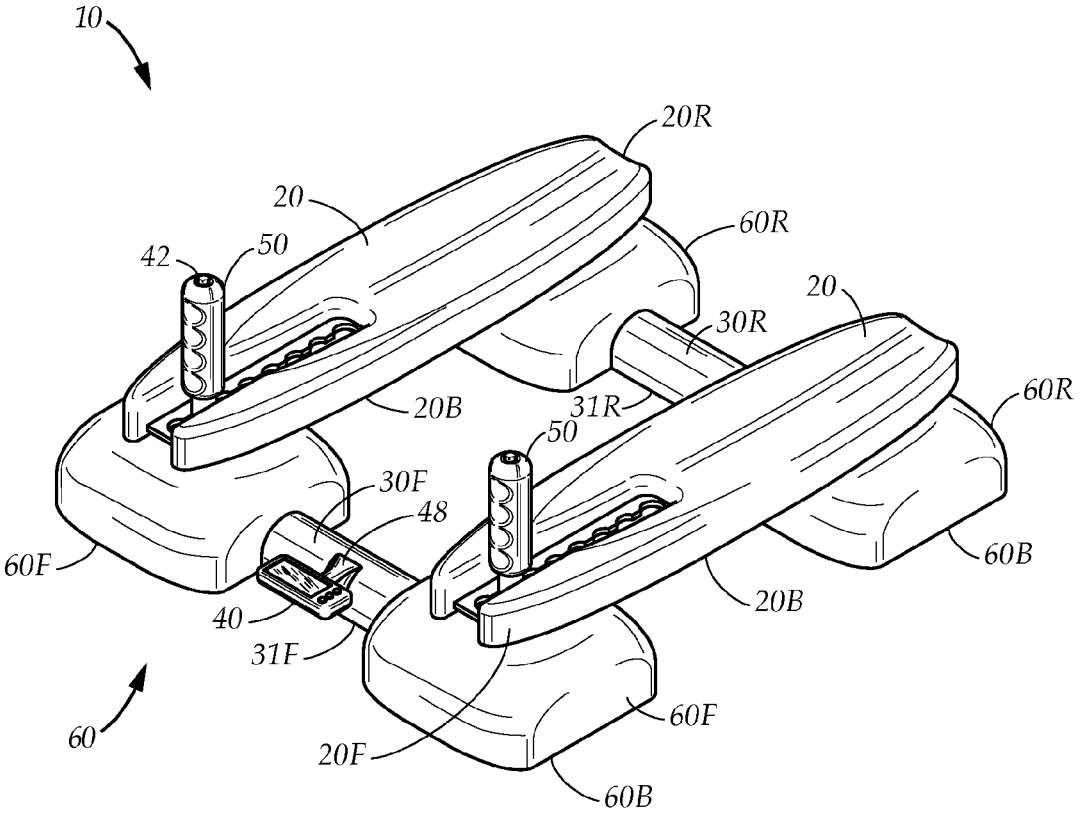
FIG. 1 is a perspective view of an example embodiment of a planking device.

FIG. 1 illustrates an example embodiment of a planking device 10 for assisting in the performance of a plank exercise. The plank exercise is well known to those of ordinary skill and is performed generally in several ways. In a front plank, a user holds steady in a push-up position with the user's body's weight borne on forearms, elbows, and toes. Head, neck and spine are maintained in a neutral, straight posture. A side plank, also popular, is performed by assuming a lateral position and maintaining the body's weight on a forearm of one arm.

Duration is key to strengthening the user's core and measuring the duration is an important part of the exercise. Without a partner or trainer, it is difficult to time the plank with a wall clock or watch while maintaining the proper neutral posture.

Users often place the forearms directly on a surface such as carpeting that creates friction on skin of the forearms. Users sometimes use a mat over a hard floor that creates pressure on the skin of the forearms. Friction and pressure often causes the user to cut the duration of the exercise.

The planking device 10 has a pair of padded arms rests 20. The arm rests 20 each have a front 20F, a rear 20R, and a bottom 20B. The arm rests 20 are coupled by a front crossbar 30F, which secures at the bottom 20B of the arm rests 20 at the arm rest front 20F, and extends between them.

The planking device has a timer 40 operative for measuring the duration of the plank exercise. The timer 40 is coupled to the front crossbar 30F so that the user can look directly at the timer 40 while keeping the head, neck and spine in the neutral position.

The planking device has a pair of grips 50 on the front of each arm rest 20F extending upwards. The grips 50 may each have a starter button 42 for selectively activating and deactivating the timer 40, the timer 40 selectively activated when a plank exercise is initiated, the timer 40 selectively deactivated when the plank exercise is completed, the timer 40 measuring the duration of the plank exercise. The starter button 42 is electronically coupled to the timer 40. In one example embodiment, both grips 50 have the starter button.

In one example embodiment, the arm rests 20 of the device are additionally coupled by a rear crossbar 30R. In a further example embodiment, the rear crossbar 30R is telescopic, operative for selectively moving the rear 20R of the arm rests 20, the arm rests 20 selectively moving from a parallel position to an angled, expanded or widened position. The front cross bar 30F may similarly be made to be telescopic, to adjust an overall spacing between the arm rests 20, to more comfortably fit different users, having different shoulder spacings.

The front cross bar 30F and rear cross bar 30R each have a pair of bases 60, including front bases 60F which form part of the front cross bar 30F, and rear bases 60R which form part of the rear cross bar 30R. Each arm rest 20 is coupled to one of the front bases 60F and one of the rear bases 60R. In one example embodiment, the bases 60 are weighted for additional stability. The bases 60 have a bottom surface 60B which contacts a flooring surface beneath the device 10.

In one example embodiment, the front crossbar 30F includes a front mid bar 31F, which extends between the front bases 60F, coupling the arm rest indirectly. In a further example embodiment, the rear crossbar 30R couples the rear bases 60R with a rear mid bar 31R.

Figure 5:
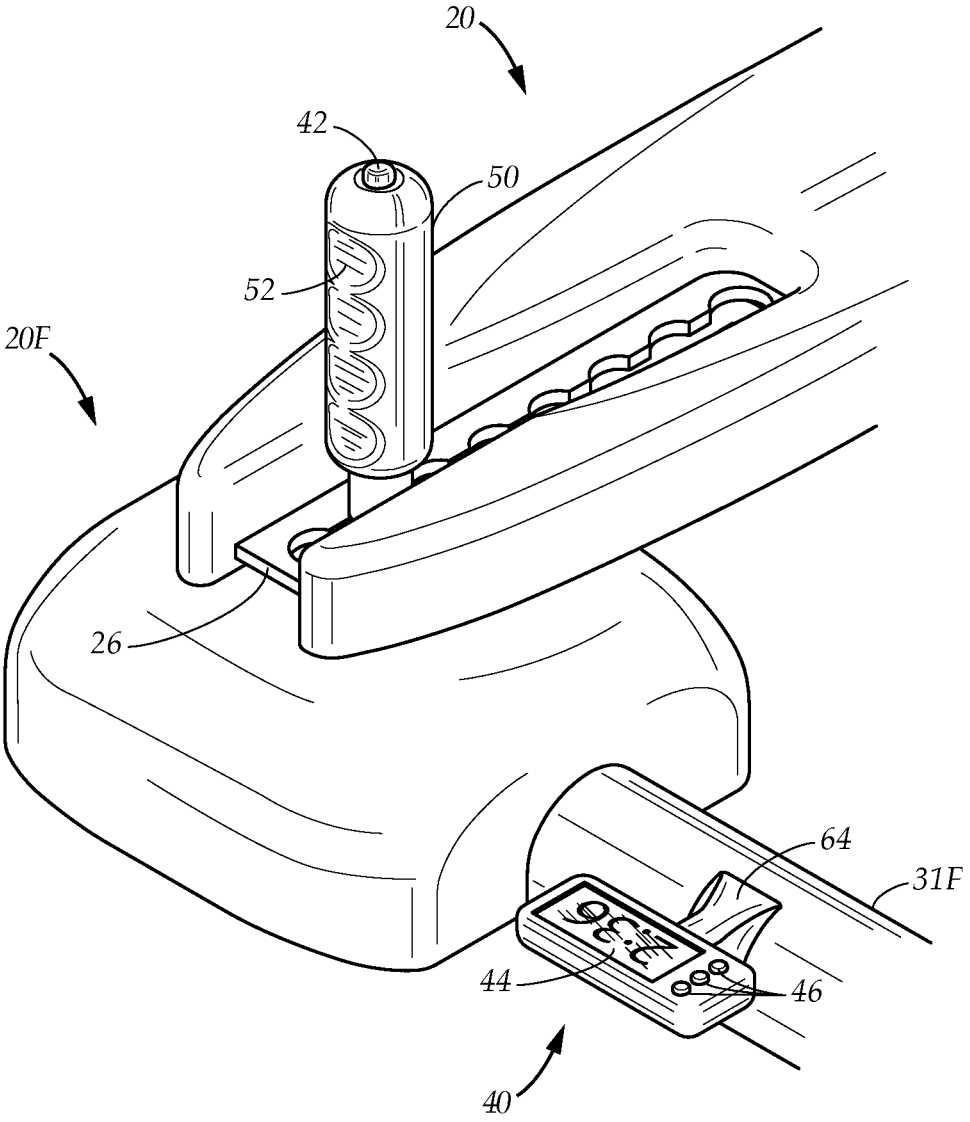
FIG. 5 is a perspective view in detail of an example embodiment of a timer and the grip of the planking device in an unlock position.

FIG. 5 shows the timer 40 and arm rest front 20F in more detail. The timer 40 is located on the front mid bar 31F, midway between the front bases 30F. The timer 40 has a upwardly facing display 44 and a plurality of buttons 46. The display 44 shows the user a plurality of duration measurements, such as split time, lapse time. The buttons 46 are operative for resetting and programming various timing functions of the timer 40. In one example embodiment, the user can set a minimum duration time as a goal and the timer sounds an alert when the goal is reached. The timer 40 is in electronic communication with the starter button 42 using a wired connection, or wireless protocol such as wi-fi, BLUETOOTH, or a similar system. Timers and electronic communication systems are well known to those of ordinary skill and further detailed discussion is outside the scope of this disclosure.

In one example embodiment, the timer 40 is attached to the front cross bar 30F by a stem 64. The stem 64 is angularly adjustable, operative for optimally adjusting the timer 40 for viewing by a user during the plank exercise. In one example embodiment, the timer 40 is rotatably coupled to the stem 84, operative for further adjusting the timer 40 for viewing during the exercise.

In one example embodiment, the arm rests 20 have an adjustable useful length. The useful length of the arm rest 20 is adjusted by selectively moving the grip 50 forward toward the front 20F of the arm rest 20, operative for extending the useful length of the arm rest 20 and selectively moving the grip 50 backward toward the rear of the arm rest, operative for shortening the useful length of the arm rest 20.

In one example embodiment, the grip 50 has a plurality of finger rests 52, operative for comfortably grasping the grip 50, allowing a thumb to be free to activate and deactivate the starter button.

Figure 3:
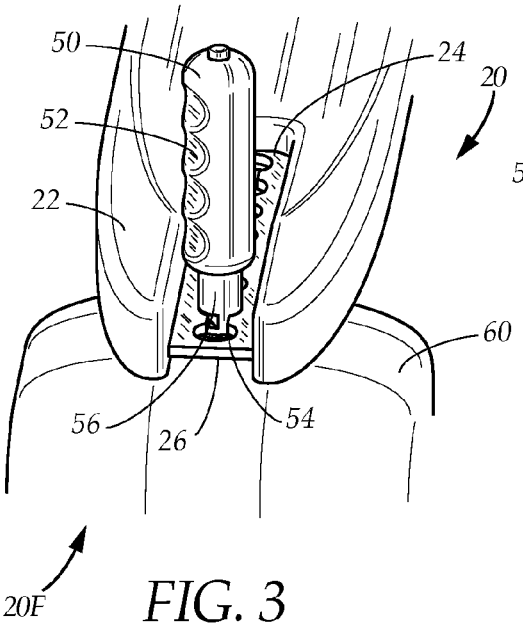
FIG. 3 is a perspective view in detail of an example embodiment of the grip of the planking device in a lock position.

FIG. 3 shows an example embodiment of how the useful length of the arm rest 20 is adjusted. The grip 50 is at the arm rest front 20F. The arm rest front 20F has a pair of branches 22 defining a recess 24 therebetween.

Figure 3A:
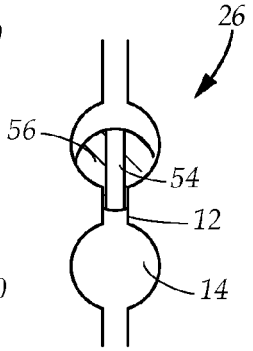
FIG. 3A is a top plan view of the grip of the planking device in the lock position.
Figure 4:
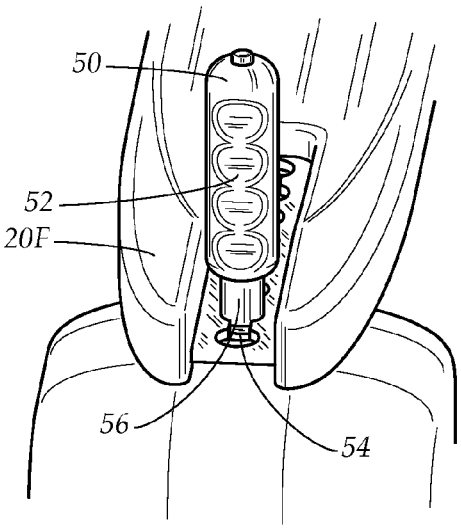
FIG. 4 is a perspective view in detail of an example embodiment of the grip of the planking device in an unlock position.
Figure 4A:
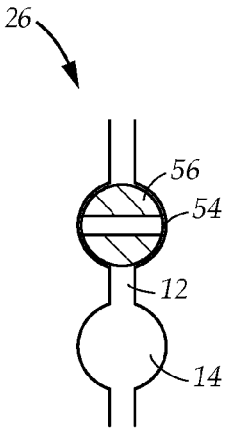
FIG. 4A is a top plan view of the grip of the planking device in the unlock position.

The recess 24 has a flat position plate 26 with a plurality of round slots 14 and a plurality of rectangular slits 12, the slits 12 connecting the round slots 14 as shown in FIG. 3A. Referring again to FIG. 3, the grip 50 has a round shank 56, the round shank 56 atop a rectangular shaft 54. The grip 50 selectively adjusts the length of the arm rest 20F by pulling the round shank 56 out of a first round slot 14, rotating the grip 50 ninety degrees in a first direction, the finger rests 52 moving towards the front 20F as shown in FIG. 4. The shaft 54 moves through the rectangular slit 12, the grip 50 is then rotated ninety degrees in a direction opposite the first direction. The round shank 56 is placed in a second round slot 14 on the plate 26 as drawn in FIG. 4A, thereby adjusting the useful length of the arm rest.

Figure 8:
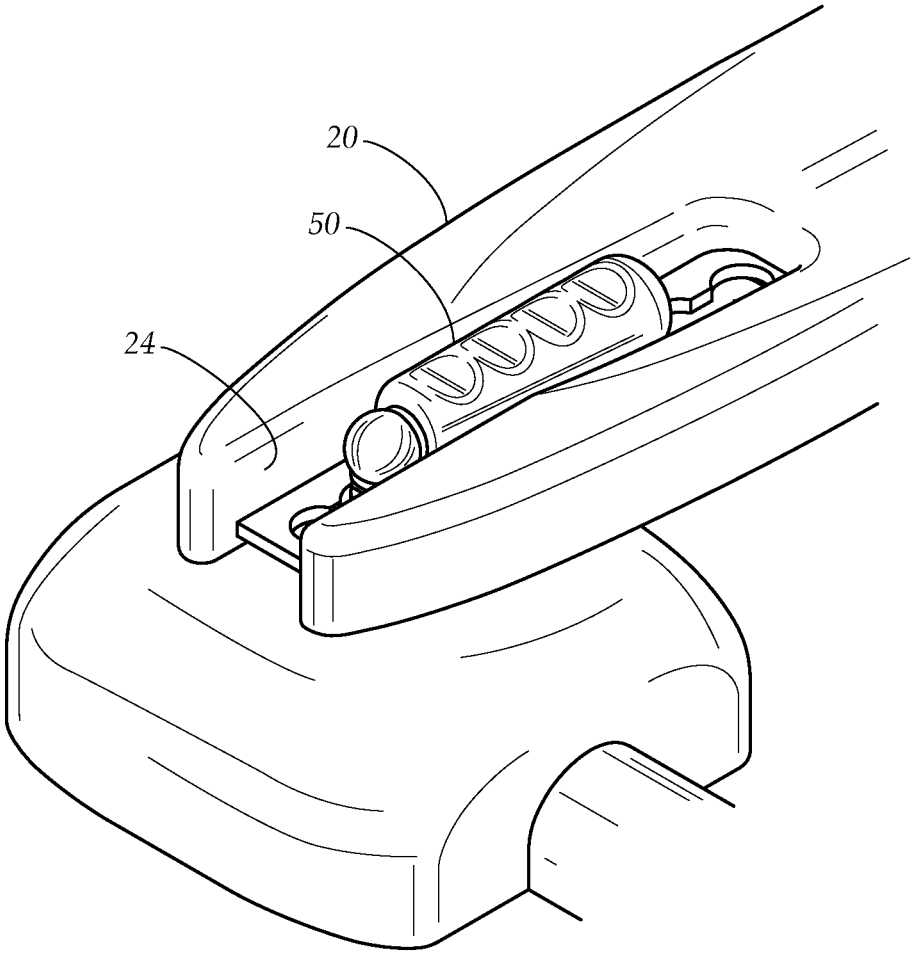
FIG. 8 is a diagrammatic perspective view, showing one of the grips folding into the recess of one of the arm rests for storage.

To facilitate compact storage of the device 10, the grips 50 may be configured to fold for storage. In particular, since the handgrips do not actually support weight of the user and are used mainly for stability, the handgrips 50 can be configured to fold rearwardly into the recess 24 of the arm rests 20 as shown in FIG. 8.

It is understood that the same result is achieved by rotating the grip 50 ninety degrees in the first direction when the first direction is toward the rear with the finger rests 52 moving towards the rear. It is further understood that other methods of adjusting the useful length of the arm rest are possible within the inventive concept.

Figure 6:
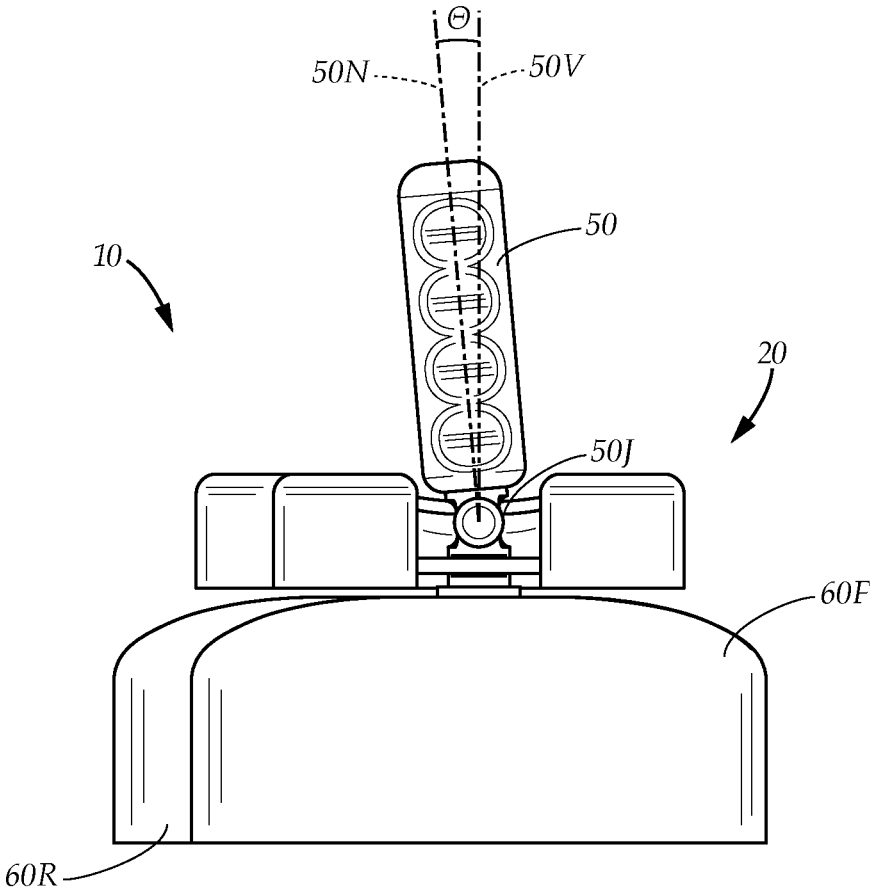
FIG. 6 is a front elevational view of an example embodiment of an arm rest of the planking device

FIG. 6 shows another example embodiment of the device 10. The grip 50 extends longitudinally along a vertical axis 50V. Note that the grip 50 is hingedly coupled to one of the front bases 60F with a hinge joint 50J, immediately above the front base 60F, and is operative for rotating to an inward position, wherein it extends along an inward axis 50N, at an angle (theta) from a vertical axis. The rotation of the grip 50 allows the user to vary the exercise dynamics by changing hand positioning.

In this front elevational drawing, the rear base 60R is not aligned behind the front base 60F. In the example embodiment having the telescopic rear crossbar, the spacing of the rear of the arm rests can be widened such that the arm rests 20 are not parallel but at an angle to each other, allowing the user to vary the exercise dynamics further.

Figure 7:
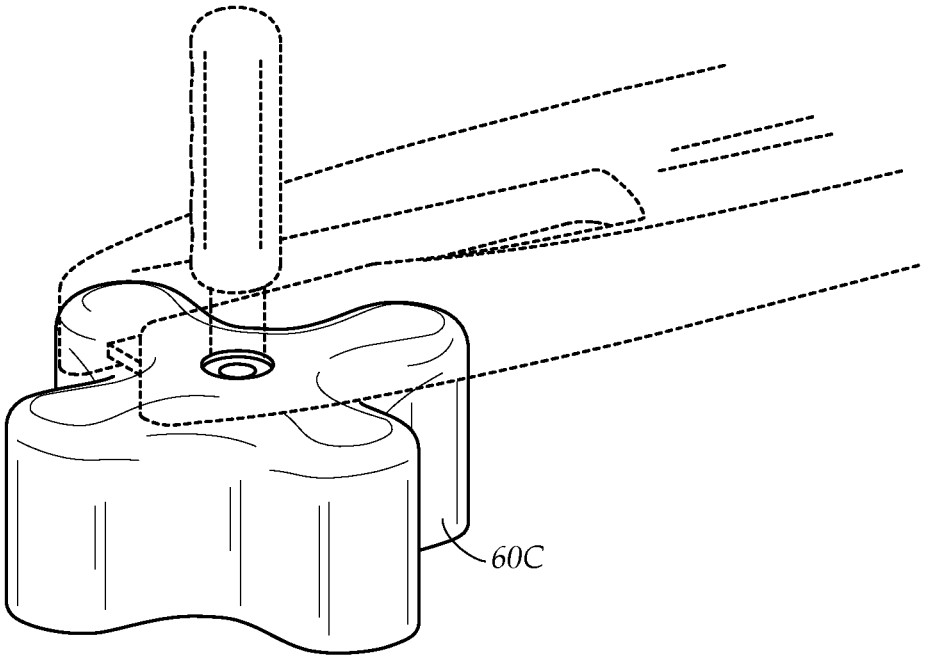
FIG. 7 is a perspective view of another example embodiment of a base of the planking device with the arm rest and grip shown in outline.

FIG. 7 illustrates a further example embodiment of the base 60C in the cloverleaf shape operative for requiring additional balancing effort during the plank exercise and requiring more effort from the core muscles.

Figure 2:
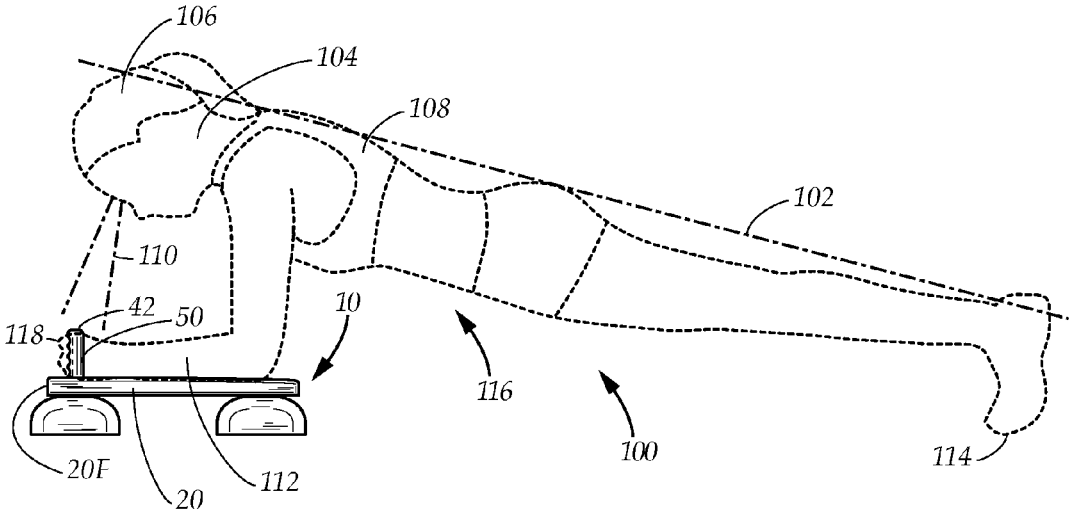
FIG. 2 is a side elevational view of the example embodiment of the planking device in use.

FIG. 2 shows the user using the device when performing the plank exercise. The user 100 places a pair of forearms 112 on a pair of arm rests 20, extending a pair of legs 116 and torso 116 having a spine 108, the legs 116 and the torso 116 straight behind the arm rests 20, the user 100 balancing on a plurality of curled toes 114.

The user grasps the pair of grips 50, a grip on the front 20F of each arm rest 20, a hand 118 on each grip 50, the user now in a proper pose for the plank exercise. The user activates the timer on the front crossbar by selecting a starter button 42 atop one of the grips 50, the starter button 42 electronically coupled to the timer, the user maintaining the proper pose while activating the timer. The user maintains the proper pose with head 106, neck 104 and spine 108 in a neutral position, forming a straight line 102. The user maintains the proper pose while monitoring the duration of the exercise, the timer within the user's line of vision 110.

The user then disengages from the proper pose and deactivates the timer by selecting the starter button 42 atop the grip 50, the timer displaying the duration of the plank exercise. The user can then check other duration measures or reset the timer. In one example embodiment, the user disengages after hearing an alert sound from the timer, indicating that a goal has been met.

While FIG. 2 shows the front plank, it is clear to those of ordinary skill that the planking device is useful for a side plank. The user takes a lateral position, placing only one arm on the arm rest having the grip with the starter button. The user raises the body up on the forearm, the body in a lateral position, the head, neck and spine in a neutral position. The exercise proceeds as described hereinabove.

A method of manufacturing the device 10 shown in FIG. 1 is herein described. The front crossbar 30F is coupled to the front 20F of the arm rests 20 and the timer 40 is coupled to the front crossbar 30F. The grips 50 are coupled to the front of each arm rest, the grips extending upwards. The first grip having a starter button 42 in electronic communication with the timer. In one example embodiment, each arm rest 20 is coupled to a pair of bases 60, a front base 60F at the front 20F of the arm rest and a rear base 60R at the rear 20R of the arm rest, the arm rest on top of the bases 60. It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a planking device. The disclosure is illustrated by example in the drawing figures, and throughout the written description. It should be understood that numerous variations are possible, while adhering to the inventive concept. Such variations are contemplated as being a part of the present disclosure.

What is claimed is:

1. A planking device, for use by a user in performing a plank exercise, comprising:

a pair of padded arm rests, the arm rests having a front and a rear;

a front cross bar coupled to the front of the arm rests and extending therebetween;

a timer operative for measuring a plank exercise duration, the timer having a display located on the front crossbar substantially midway between the arm rests;

a pair of grips, a grip on the front of each arm rest extending upwardly, at least one of the grips having a starter button in communication with the timer for selectively activating the timer when a plank exercise is initiated, the timer measuring a duration of the plank exercise and displaying to the user the duration on the display; and a pair of front bases located beneath the arm rests at the front, the front cross bar connected between the front bases, each arm rest having a pair of branches at the front of said arm rest that form a recess, each of the grips connected to one of the front bases through one of the recesses.

2. The planking device as recited in claim 1, further comprising a pair of rear bases, connected to the rear of the arm rests, and a rear cross bar, extending between the rear bases.

3. The planking device as recited in claim 2, wherein the arm rests have an adjustable useful length, the useful length of the arm rest adjusted by selectively moving the grip forward toward the front of the arm rest, operative for extending the useful length of the arm rest and selectively moving the grip backward toward the rear of the arm rest, operative for shortening the useful length of the arm rest.

4. The planking device as recited in claim 3, wherein the grips are each secured to its associated front base with a flat plate having a plurality of round slots and a plurality of rectangular slits, the slits connecting the round slots, the grips of the device further comprising a round shank, the round shank atop a rectangular shaft, the grip selectively adjusting the length of the arm rest by pulling the round shank out of a first round slot, rotating the grip ninety degrees in a first direction, moving the shaft through the rectangular slit, rotating the grip ninety degrees in an direction opposite the first direction and placing the round shank in a second round slot, thereby adjusting a useful length of the arm rest for the user.

5. The planking device as described in claim 4, wherein the grip has a plurality of finger rests, operative for providing a gripping surface.

6. The planking device as described in claim 5, wherein the grip is hingedly coupled to the front base, the grip having a vertical axis and normally extending longitudinally to the vertical axis and also operative for rotating so that the grip extends at an inward angle from the vertical axis.

7. The planking device as recited in claim 6, wherein the grip may selectively fold into the recess for storage.

8. The planking device as described in claim 7, wherein the cross bar includes a front mid bar, wherein timer is coupled to the front mid bar with a stem, the stem angularly adjustable, operative for optimally adjusting the timer for viewing by a user during the plank exercise.

9. A planking device, for use by a user in performing a plank exercise, comprising:

a pair of front bases;

a pair of rear bases;

a front cross bar extending between the front bases;

a rear cross bar extending between the rear bases;

a pair of arm rests, each arm rest having a front and rear and extending between and attached to one of the rear bases and one of the front bases, each arm rest has a recess near its front;

a timer operative for measuring a plank exercise duration, the timer having a display located on the front crossbar substantially midway between the arm rests; and a pair of grips, a grip on the front of each arm rest extending upwardly, the grips each having a starter button in communication with the timer for selectively activating the time when a plank exercise is initiated, the timer measuring a duration of the plank exercise and displaying to the user the duration on the display, wherein each grip is secured to one of the front bases and extends through one of the recesses; and wherein the grips are selectively foldable into the recesses for storage.

10. The planking device as recited in claim 9, wherein the arm rests have an adjustable useful length, the useful length of the arm rest adjusted by selectively moving the grip forward toward the front of the arm rest, operative for extending the useful length of the arm rest and selectively moving the grip backward toward the rear of the arm rest, operative for shortening the useful length of the arm rest.

11. The planking device as recited in claim 10, wherein the grips are each secured to its associated front base with a flat plate having a plurality of round slots and a plurality of rectangular slits, the slits connecting the round slots, the grips of the device further comprising a round shank, the round shank atop a rectangular shaft, the grip selectively adjusting the length of the arm rest by pulling the round shank out of a first round slot, rotating the grip ninety degrees in a first direction, moving the shaft through the rectangular slit, rotating the grip ninety degrees in an direction opposite the first direction and placing the round shank in a second round slot, thereby adjusting a useful length of the arm rest for the user.

12. The planking device as recited in claim 11, wherein the grip is hingedly coupled to the front base, the grip having a vertical axis and normally extending longitudinally to the vertical axis and also operative for rotating so that the grip extends at an inward angle from the vertical axis.

* * * * *